US006719240B2

(12) United States Patent
Hanson et al.

(10) Patent No.: US 6,719,240 B2
(45) Date of Patent: Apr. 13, 2004

(54) SYSTEM AND METHOD FOR UNWINDING TISSUE WEBS

(75) Inventors: John R. Hanson, Appleton, WI (US); Robert J. Seymour, Appleton, WI (US); Mike E. Daniels, Neenah, WI (US); James Baggot, Menasha, WI (US); Randy LeValley, Neenah, WI (US); Edward Marksman, Menasha, WI (US); Preston O'Connor, Appleton, WI (US); Kenneth Pigsley, Greenville, WI (US); Douglas C. Thomas, Appleton, WI (US); Jeffrey Greiner, Kaukauna, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 63 days.

(21) Appl. No.: 10/010,952

(22) Filed: Nov. 13, 2001

(65) Prior Publication Data

US 2003/0089816 A1 May 15, 2003

(51) Int. Cl.[7] ..... B65H 19/16
(52) U.S. Cl. ..... 242/559.3; 242/554.6
(58) Field of Search ..... 242/559, 559.3, 242/559.4, 554, 554.5, 554.6, 551, 594.5, 594.6

(56) References Cited

U.S. PATENT DOCUMENTS

| | | | |
|---|---|---|---|
| 2,216,286 A | | 10/1940 | Wood |
| 2,617,606 A | | 11/1952 | Whatmore |
| 3,086,725 A | | 4/1963 | Zernov |
| 3,123,315 A | | 3/1964 | Couzens |
| 3,315,908 A | | 4/1967 | Wetzler |
| 3,430,881 A | | 3/1969 | Ebneter |
| 3,552,670 A | | 1/1971 | Herman et al. |
| 3,592,403 A | | 7/1971 | Schmitt et al. |
| 3,655,143 A | | 4/1972 | Wallis |
| 3,692,251 A | | 9/1972 | Melead |
| 3,695,539 A | * | 10/1972 | Lindstaedt |
| 3,740,296 A | | 6/1973 | McDonald |
| 3,753,833 A | | 8/1973 | Bassett et al. |
| 3,831,876 A | | 8/1974 | Phelps et al. |
| 3,858,819 A | | 1/1975 | Butler, Jr. |
| 4,132,371 A | | 1/1979 | Byrt |
| 4,204,650 A | | 5/1980 | Mengel |
| RE31,192 E | | 3/1983 | Andreasson |
| 4,466,577 A | | 8/1984 | Heinz et al. |
| 4,586,673 A | | 5/1986 | Tokuno et al. |
| 4,735,372 A | | 4/1988 | Seki |

(List continued on next page.)

FOREIGN PATENT DOCUMENTS

| | | |
|---|---|---|
| WO | 9846509 | 10/1998 |
| WO | 9932383 | 7/1999 |
| WO | 0061482 | 10/2000 |
| WO | 0160729 | 8/2001 |
| WO | WO 0164562 A2 | 9/2001 |

OTHER PUBLICATIONS

PCT Search Report, Jan. 13, 2003.

*Primary Examiner*—William A. Rivera
(74) *Attorney, Agent, or Firm*—Dority & Manning, P.A.

(57) ABSTRACT

A system and process for unwinding rolls of material is disclosed. The system is particularly well suited for unwinding soft, high-bulk tissue webs. In one embodiment, the system includes the combination of a center unwind device and a surface unwind device to unwind the roll of material in a primary unwind location. Once the roll of material is partially unwound, the roll is then moved to a secondary unwind location while a new roll of material is moved into the primary unwind location. In this manner, multiple rolls of material can be continuously unwound without substantial downtime.

41 Claims, 8 Drawing Sheets

U.S. PATENT DOCUMENTS 4,757,951 A * 7/1988 Ludszeweit
4,773,609 A 9/1988 Steffen et al.
4,875,633 A * 10/1989 Mochizuki et al.
4,881,695 A * 11/1989 Beisswanger
5,025,998 A 6/1991 Hutzenlaub et al.
5,101,701 A * 4/1992 Boldrini et al.
5,289,984 A 3/1994 Sohma
5,344,089 A 9/1994 Crowley et al.
5,584,446 A 12/1996 Delmore et al.
5,697,575 A * 12/1997 Moore et al.
5,709,354 A 1/1998 Blandin et al.
5,709,355 A 1/1998 Kinnunen et al.
5,730,389 A 3/1998 Biagiotti
5,906,333 A * 5/1999 Fortuna et al.
6,030,496 A * 2/2000 Baggot et al.
6,079,661 A 6/2000 Klimek et al.
6,308,909 B1 10/2001 McNeil et al.
6,533,212 B1 * 3/2003 Tafel, II

* cited by examiner

SYSTEM AND METHOD FOR UNWINDING TISSUE WEBS

BACKGROUND OF THE INVENTION

In the production of many paper products, such as tissue and towel products, paper webs are typically formed in a paper making system and initially stored in large parent rolls. The parent rolls are unwound for finishing operations, such as embossing, printing, ply attachment, perforating, and the like and then rewound into retail-sized logs or rolls.

Unwinding and further processing parent rolls made from paper webs, particularly soft and high bulk tissue webs, can be challenging due to the fact that the product can easily break or become damaged. Unwinding such rolls in a fast and efficient manner can also be problematical. For instance, in many traditional operations, parent rolls are unwound one roll at a time. After a parent roll is unwound, the machine is stopped for the removal of the core and deployment of a new parent roll. The downtime associated with parent roll changeovers, creates a substantial reduction in total available run time that reduces the maximum output that can be obtained from a rewinder line.

A center driven unwind system that has provided great improvements in systems and processes for unwinding parent rolls is disclosed in U.S. Pat. No. 5,906,333 to Fortuna, et al. and U.S. Pat. No. 6,030,496 to Baggot, et al., which are incorporated herein by reference in their entireties. In the above patents, a system is disclosed which includes a pair of horizontally spaced apart side frames. Each side frame includes an elongated arm capable of engaging a parent roll. The elongated arms are operably associated with variable speed drive means for unwinding the parent roll. Once the parent roll is partially unwound, the arms move the parent roll to a core placement table which rotatably supports the partially unwound roll. The elongated arms then move away from the core placement table to engage a second parent roll. A leading end portion of the web on the second parent roll is bonded to a trailing end of the partially unwound first parent roll to form a joined web.

Although the above system has provided great advancements, further improvements are still needed in the handling and unwinding of parent rolls. In particular, a need exists for a system capable of unwinding multiple parent rolls without a significant amount of down time. Further improvements are also needed for systems that can unwind high bulk tissue webs without breaking or otherwise damaging the webs as they are unwound.

SUMMARY OF THE INVENTION

In general, the present invention is directed to a system and method for unwinding rolls of material. The system and process of the present invention can be used to unwind various different types of materials. The system, however, is particularly well suited to unwinding paper webs, especially soft, high bulk tissue webs. Without damaging the webs.

In one embodiment, the unwind system of the present invention includes a frame defining a primary unwind location and a secondary unwind location. A first drive device adapted to engage a center position of a roll of material to be unwound is positioned to engage the roll of material when the roll of material is in the primary unwind location. As used herein, the "center portion" of a roll of material generally refers to whatever object or device the material is wound around and can include, for instance, a core, a spool, or the material itself in a coreless roll. The system further includes a second drive device adapted to engage an outside surface of the roll of material when the roll of material is in the primary unwind location. The second drive device operates in conjunction with the first drive device to unwind the roll of material. For instance, the first drive device can be a center unwind device, while the second drive device can be a surface unwind device. The second drive device can include a driven belt that is movable between a roll engagement position and a non-engagement position. In one embodiment, the second drive device is used in conjunction with the first drive device to initially unwind the material. Once the roll of material has reached a preselected unwind speed, however, the second drive device can then be disengaged. In this manner, the second drive device can be used to accelerate the roll of material without causing any material breakage.

The system of the present invention can further include a transfer mechanism that transfers the roll of material from the primary unwind location to the secondary unwind location after a portion of the material has been unwound from the roll. A third drive device is positioned at the secondary unwind location and is configured to further unwind the roll of material after the roll of material has been transferred to the secondary unwind location.

In one embodiment, the first drive device is configured to move with the roll of material from the primary unwind location to the secondary unwind location while continuously unwinding the roll. Once transferred to the secondary unwind location, the first drive device can disengage the roll and return to the primary unwind location, while unwinding is continued at the secondary location by the third drive device.

In an alternative embodiment, the second drive device moves with the roll of material from the primary unwind location to the secondary unwind location for continuous unwinding during the transfer.

The third drive device can be a center unwind device that engages a core or spool of the roll of material that is to be unwound or, alternatively, can be a surface unwind device that engages a surface of the roll of material that is to be unwound. In one embodiment, the third drive device can be configured to move from the secondary unwind location to the primary unwind location to engage a roll of material and continuously unwind the material while the material is being transferred to the secondary unwind location, as opposed to using the first drive device or the second drive device.

As described above, when transferring a roll of material from the primary unwind location to the secondary unwind location, one of the drive devices can be used to continuously unwind the roll. It should be understood, however, that in one embodiment of the present invention, the roll of material can be transferred from the primary unwind location to the secondary unwind location without continuous unwinding. In fact, since the primary unwind location and the secondary unwind location are relatively closely spaced together, such a small interruption in the unwinding process will not significantly effect the efficiency of the system.

Once a roll of material is partially unwound and transferred from the primary unwind location to the secondary unwind location, a second roll of material can be placed in the primary unwind location for subsequent unwinding. In this regard, the system of the present invention can include an air jet nozzle for emitting air onto a leading end of the second roll of material positioned at the primary unwind location. The air jet nozzle can blow the leading end of the second web onto the first web being unwound at the secondary unwind location. Once the leading end of the second roll of material is placed on top of the first roll of material being unwound, the plies can be attached together through pressure or the use of an adhesive. Once attached together, unwinding of the first roll of material can be ceased causing the material to break. Continuous unwinding of the second roll of material can then commence while the remains of the first roll of material can be removed from the system.

In one embodiment of the present invention, the frame can include a staging area and a collecting area in addition to the primary unwind location and the secondary unwind location. Rolls of material to be unwound can be kept in the staging area for transfer to the primary unwind location. For example, in one embodiment, the first drive device can be configured to move to the staging area and engage a roll of material and move with the roll of material to the primary unwind location.

The collecting area can collect the unwound cores or spools of the rolls of material. Once ejected from the secondary unwind location, the remainder of the unwound rolls of material can be fed by gravity to the collecting area.

Although the relative location of the different areas on the frame can be changed as desired, in one embodiment, the staging area can be located generally at the same elevation as the primary unwind location. The secondary unwind location, on the other hand, can be positioned below the primary unwind location. The collecting area can be positioned at an elevation lower than the secondary unwind location and generally below the staging area.

If desired, the system of the present invention can be completely automated. For instance, the system can include a controller, such as a microprocessor or a programmable logic unit. The controller can be used to control all of the drive devices for unwinding a roll according to the process of the present invention. In order to automate the system, the system can include various sensors for indicating when it is time to transfer rolls from one location to the next. For example, in one embodiment, the system can include a roll diameter sensor that sends information to the controller. The roll diameter sensor can sense information about the diameter of a roll being unwound in the primary unwind location. Once the roll reaches a predetermined diameter, the controller can be used to automatically transfer the roll to the secondary unwind location.

A speed sensor can also be incorporated into the system for determining the unwind speed of a roll of material in the primary unwind location. The speed sensor can be used to indicate when it is time to engage or disengage the second drive device.

Other features, and aspects of the present invention are discussed in greater detail below.

BRIEF DESCRIPTION OF THE DRAWINGS

A full and enabling disclosure of the present invention, including the best mode thereof to one of ordinary skill in the art, is set forth more particularly in the remainder of the specification, including reference to the accompanying figure in which.

Figure 1:
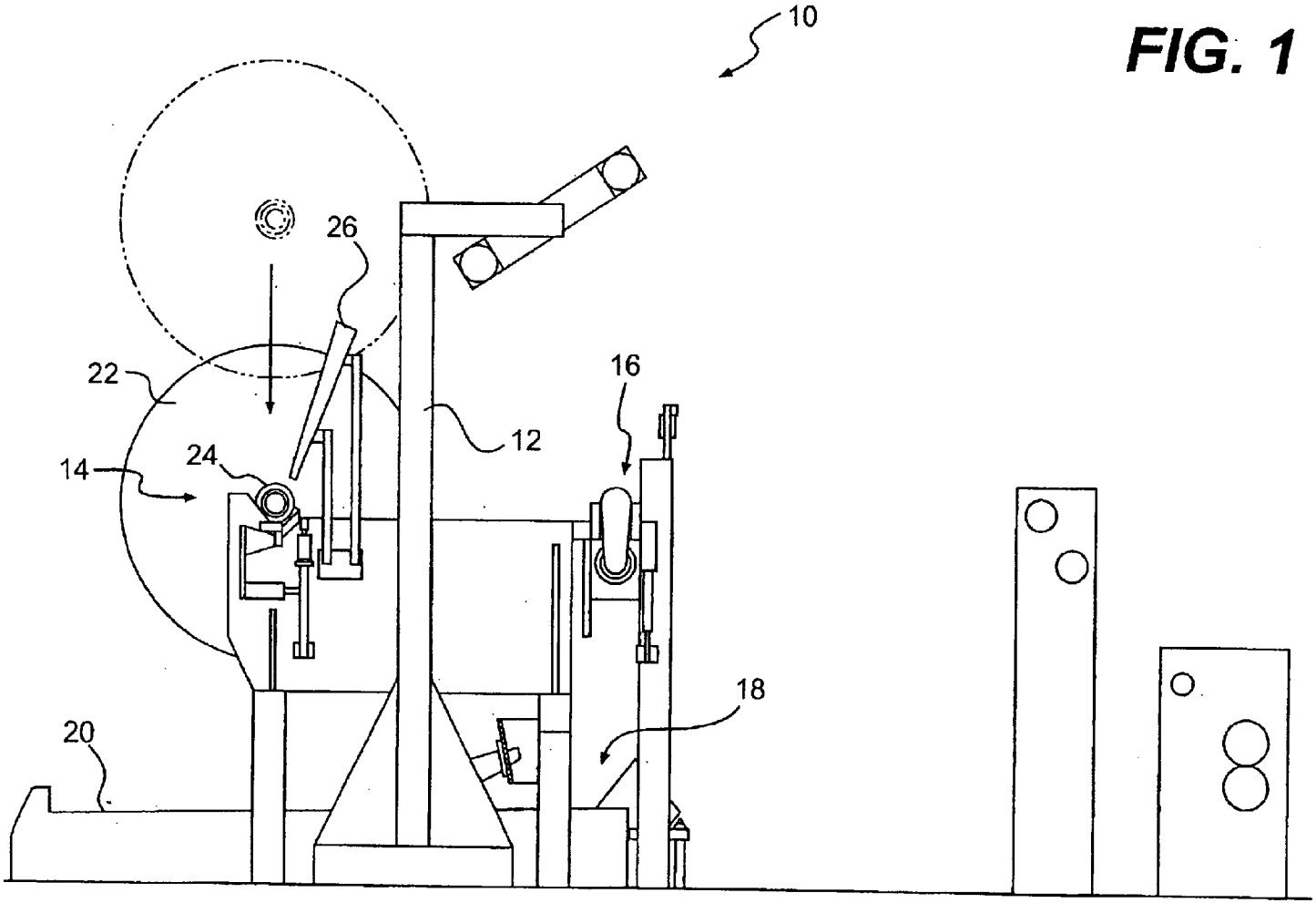
FIG. 1 is a side view of one embodiment of a system made in accordance with the present invention showing a roll of material being loaded into a staging area.

Repeat use of reference characters in the present specification and drawings is intended to represent same or analogous features or elements of the present invention.

DETAILED DESCRIPTION

Reference now will be made in detail to the embodiments of the invention, one or more examples of which are set forth below. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents.

The present invention is generally directed to a system and process for unwinding rolls of material. The system of the present invention can be used in various applications, such as for unwinding a previously formed paper web, such as a tissue web. While being unwound, the paper web can be fed through various finishing operations, such as calendering, embossing, printing, ply attachment, perforating, and the like. Of particular advantage, the system of the present invention is well adapted to unwinding high bulk and generally low strength products without damaging the products. Further, the system of the present invention is capable of unwinding the materials efficiently without a substantial amount of down time.

Referring to FIGS. 1 through 9, a system generally 10 made in accordance with the present invention is illustrated. For purposes of explanation, FIGS. 1 through 7 generally show the sequential steps of how one embodiment of a system of the present invention can be used to unwind rolls of material.

Referring to FIG. 1, the system 10 includes a frame 12. As shown, the frame 12 includes a staging area 14 for receiving rolls of material, a primary unwind location 16, a secondary unwind location 18, and a collecting area 20. In general, a roll of material 22 is first placed in the staging area 14 and transferred to the primary unwind location 16. The roll of material 22 is partially unwound at the primary unwind location 16 before being transferred to the secondary unwind location 18 where further unwinding takes place. Once unwound, the remainder of the roll is then ejected from the secondary unwind location 18 and is collected at the collecting area 20. Once ejected from the secondary unwind location 18, the remainder of the roll of material can roll by various means including gravity to the collecting area 20.

In FIG. 1, the roll of material 22 being loaded onto the system includes a core 24. It should be understood, however, that the system of the present invention can also be used to unwind rolls wound on spools and coreless rolls.

Any suitable roll of material can be unwound according to the process of the present invention. As stated above, however, the system is particularly well suited for unwinding paper products. Such paper products can include paper towels, industrial wipers, bath tissue, facial tissue, and the like. Of particular advantage, the system of the present invention can be used to unwind large rolls of a very soft and high bulk tissue without damaging the tissue.

The tissue can be, for instance, a facial tissue or a bath tissue. The tissue can be made predominantly of pulp fibers and can be creped or uncreped. For example, the tissue can be a web creped from a Yankee dryer or, alternatively, can be an uncreped through air dried fabric.

One embodiment of a suitable high bulk tissue that can be unwound according to the present invention is disclosed in U.S. Pat. No. 5,607,551 to Farrington, Jr., et al. which is incorporated herein by reference. The '551 patent particularly describes soft, high-bulk uncreped through dried tissue sheets. Such tissues can be characterized by bulk values of about 9 cubic centimeters per gram or greater (before calendering), more specifically from about 10 to about 35 cubic centimeters per gram, and still more specifically from about 15 to about 25 cubic centimeters per gram.

The basis weight of paper products processed according to the present invention can vary depending upon the particular application. For instance, when unwinding paper products, the basis weight of the rolled products can range from about 5 lbs per ream to about 120 lbs per ream. Tissue webs typically have a basis weight of below about 30 lbs per ream, and particularly below about 30 lbs per ream.

The initial diameter of the rolls of materials unwound in the system of the present invention can also vary depending upon the particular application. When unwinding paper products, for instance, the roll of materials can have a diameter of at least about 60 inches and particularly about 80 inches. More particularly, many paper rolls for use in present invention can have diameters greater than about 120 inches, such as from about 130 inches to about 250 inches. The width of such products can also vary such as from about 55 inches to about 225 inches or greater.

As shown in FIG. 1, the first roll of material 22 is loaded onto the frame 12 at the staging area 14. For most applications, the roll of material 22 will be loaded onto the frame 12 using a crane or similar lifting device. To help assist in guiding the roll of material onto the frame, the system of the present invention can include one or more guide rails 26. For example, in one embodiment, the system can include two guide rails located on opposite sides of the frame.

Figure 2:
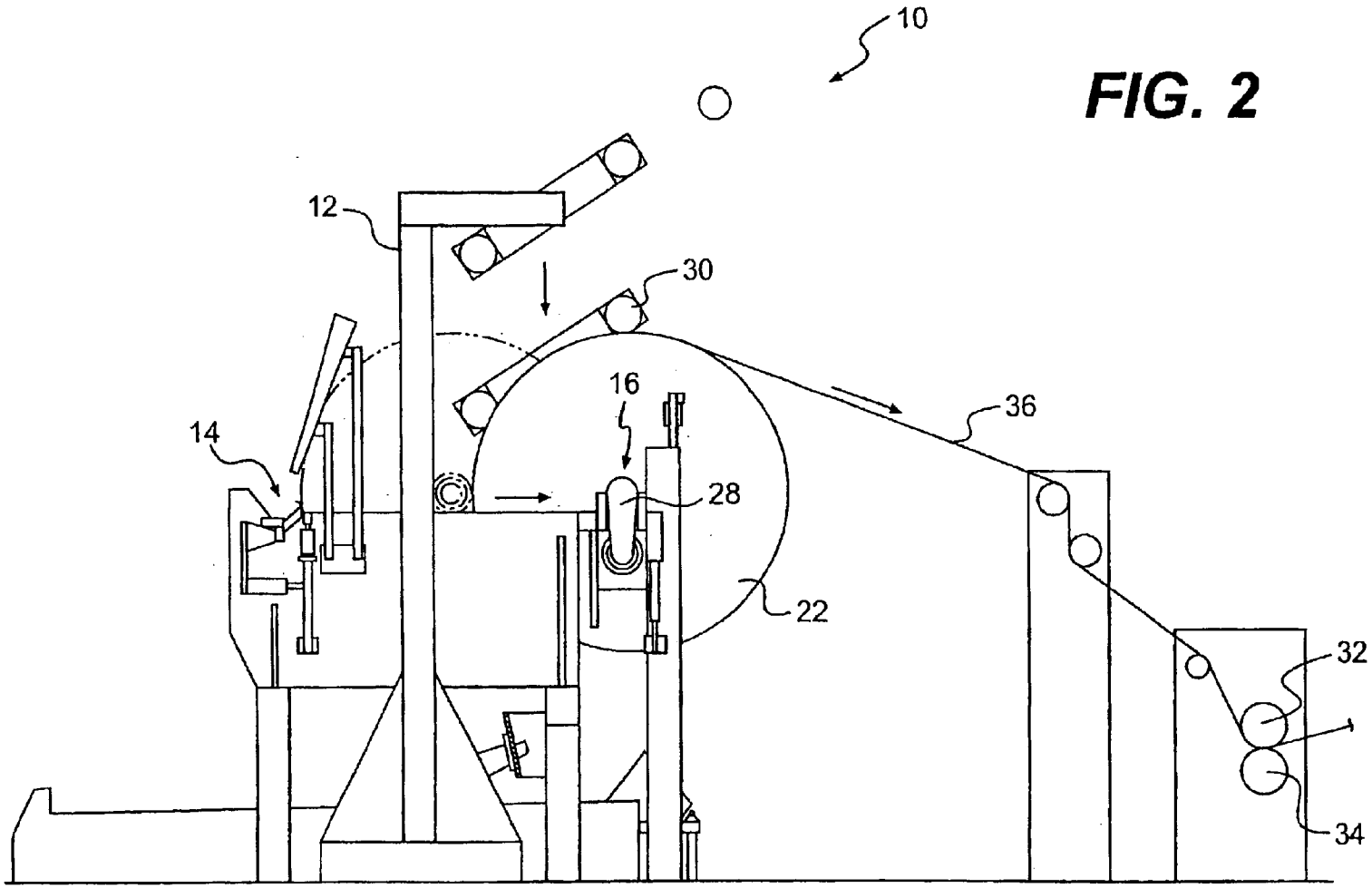
FIG. 2 is a side view of the system illustrated in FIG. 1 showing a roll of material being moved to a primary unwind location.

As shown in FIG. 2, from the staging area 14, the roll of material 22 is transferred to the primary unwind location 16 for unwinding. As shown, at the primary unwind location 16, the roll of material 22 is engaged by a first drive device 28 for unwinding the material.

In general, any suitable transfer mechanism can be used in order to transfer the roll of material 22 from the staging area 14 to the primary unwind location 16. As shown in FIG. 2, in this embodiment, the roll of material 22 is guided along opposing rails located on the frame 12 until the roll reaches the primary unwind location. Alternatively, however, a pair of bearings or chucks can engage each side of the roll of material 22 and move the roll to the primary unwind location 16 using movable arms, hydraulic cylinders, pneumatic cylinders, ball screws, or pushers. In still another alternative embodiment of the present invention, the first drive device 28 can move to the staging area 14, engage the roll of material 22 and move it to the primary unwind location 16.

As stated above, once the roll of material is transferred to the primary unwind location, the first drive device 28 engages and unwinds the material. The first drive device 28 is generally referred to as a center unwind device as it engages the center portion 24 of the roll of material 22. For instance, the first drive device 28 can include a retractable chuck that engages the core or spool 24 of the roll 22. The chuck can be placed in operative association with a belt that is driven by a motor.

In accordance with the present invention, besides the first drive device 28, the system can also includes a second drive device 30 positioned at the primary unwind location 16. The second drive device 30 can be a surface unwind device that assists in rotating the roll of material 22 by applying a tangential force to the outside surface of the roll.

In general, any suitable surface unwind device can serve as second drive device 30. For instance, the surface unwind device disclosed in U.S. Pat. No. 5,730,389 to Biagiotti, which is incorporated herein by reference, can be used in the present invention.

In one embodiment, the second drive device 30 can include a driven belt that is placed in contact with the roll of material 22. Alternatively, however, one or more driven rollers can also be placed in contact with the roll.

As shown, the second drive device 30 is moveable between a non-engagement position located off of the roll of material 22 and an engagement position located against the roll of material. In this manner, the second drive device 30 can be used to selectively assist in unwinding rolls if desired according to the present invention.

The present inventors have discovered various benefits and advantages can be obtained when using a center unwind device in conjunction with a surface unwind device. In particular, the second drive device 30 can provide supplemental torque assist from the outside of the roll of material 22 while the first drive device 28 couples to one end or both ends of the core or spool to transmit torque through the layers of material. By providing supplemental torque from the outside of the parent roll, a more equal distribution of torque transmission through each layer of the material is obtained. This method of torque transmission is especially desirable during initial acceleration of low density, high bulk tissue rolls when slippage between layers and breakage is most likely to occur.

Although the second drive device 30 can be used to unwind rolls continuously, for most applications, the second device 30 is only used to initiate unwind acceleration and/or deceleration of very large diameter rolls. For instance, in one embodiment of the present invention, initial rotation of the roll of the material 22 is begun by a combination of the first drive device 28 and the second drive device 30. Once the roll reaches a particular rotational speed, however, the second drive device 30 can be disengaged, allowing all torque transmission to take place via the first drive device 28. When unwinding high bulk tissue webs contained in a roll having a diameter of about 85 inches are larger, it is generally desirable to drive the roll solely through the shaft once the roll has attained a desired unwind speed in order to avoid potential roll/sheet damage that can be caused by certain surface drive devices.

As shown in FIG. 2, a web 36 is unwound from the roll of material 22 and further processed as desired. As described above, the web can be fed through various finishing operations or can simply be unwound in order for repackaging. In the embodiment illustrated in FIG. 2, the web 36 is shown being fed through a pair of nipped rolls 32 and 34.

Figure 3:
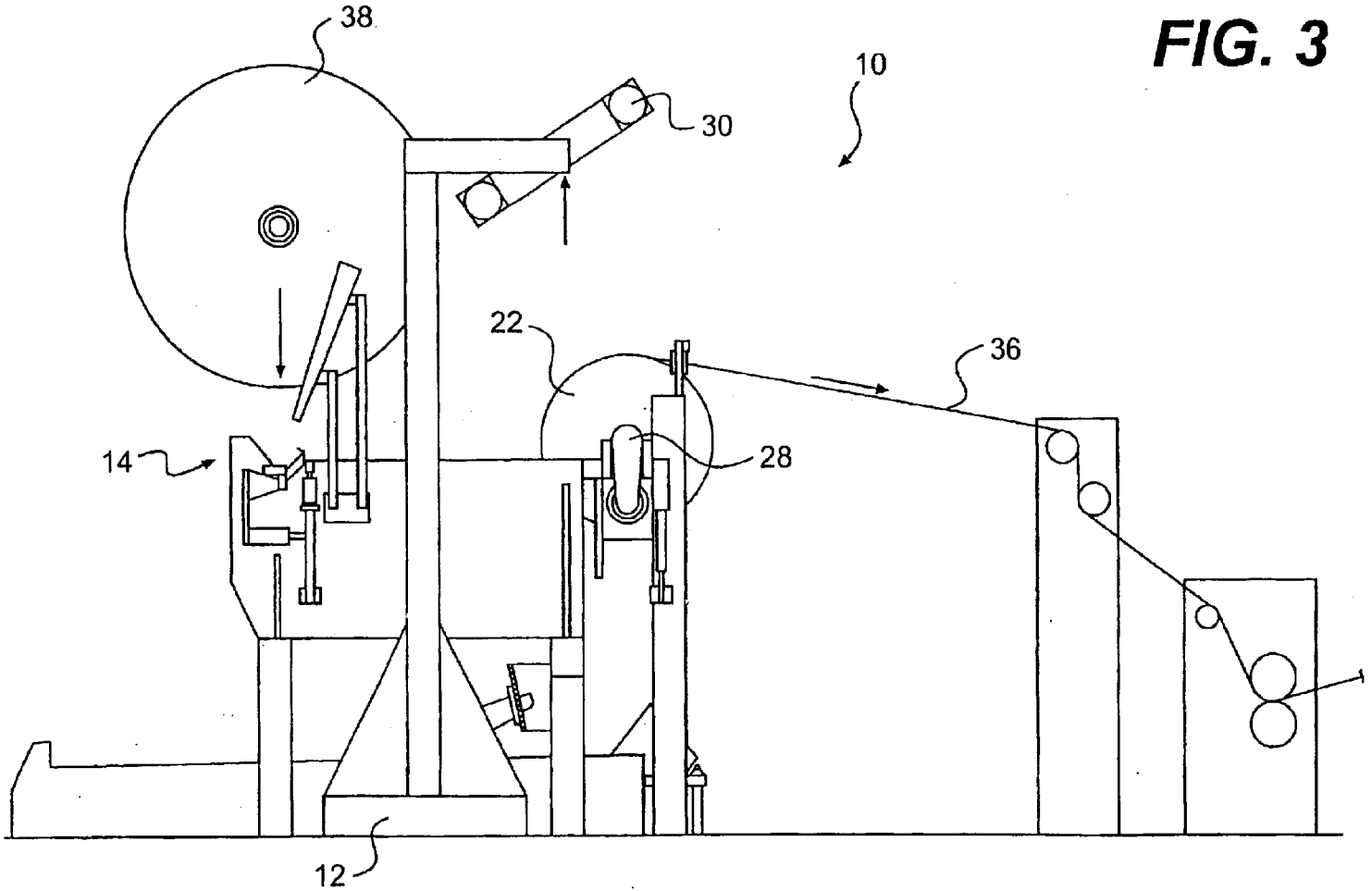
FIG. 3 is a side view of the system illustrated in FIG. 1 showing the unwinding of a roll at a primary unwind location while a new roll of material is transferred to a staging area.

Referring to FIG. 3, the unwinding of the roll of material 22 is shown after the second drive device 30 has been disengaged. Further rewinding is done solely by the first drive device 28.

Figure 4:
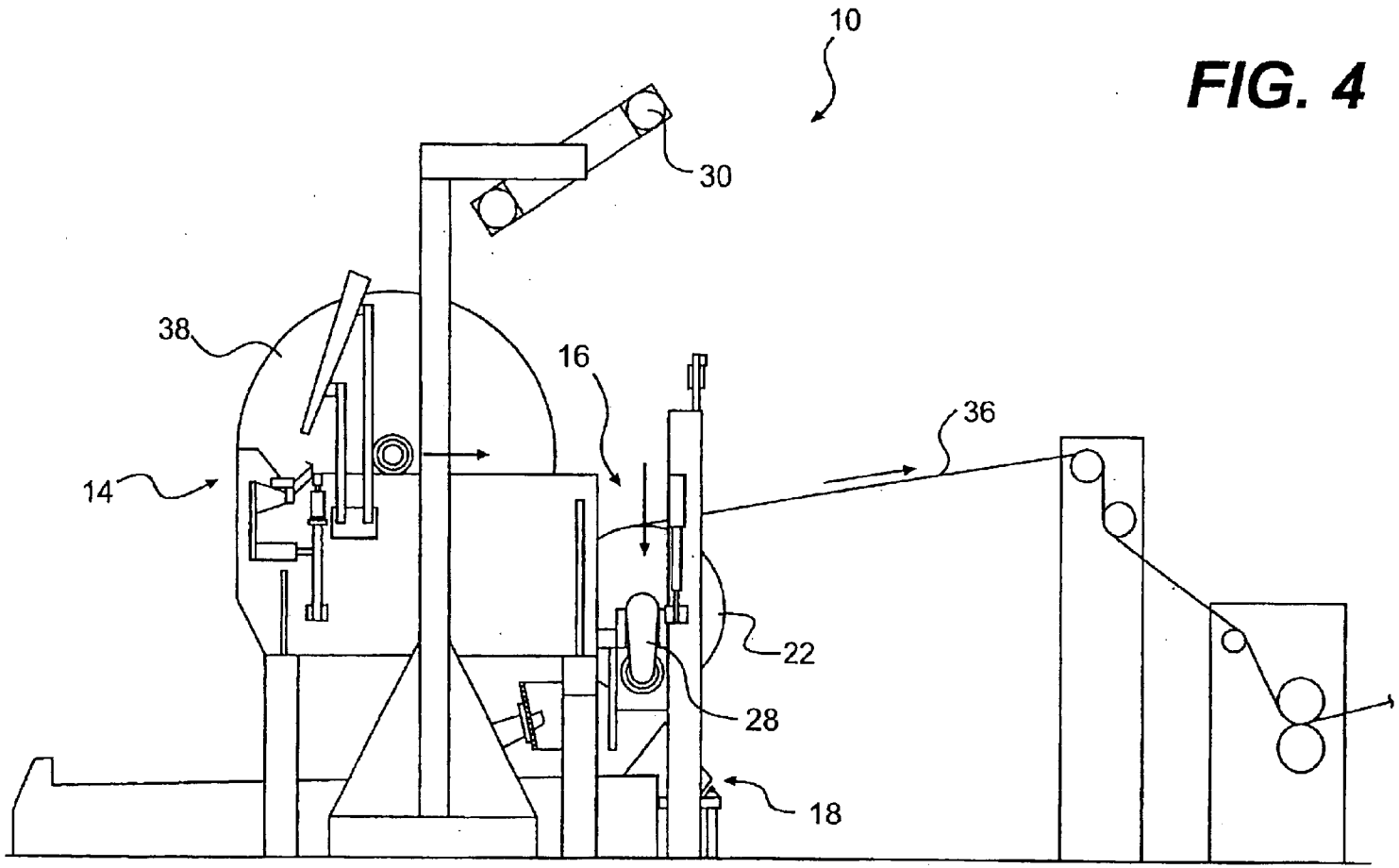
FIG. 4 is a side view of the system illustrated in FIG. 1 showing a roll of material that is unwinding being transferred from a primary unwind location to a secondary unwind location while a new roll of material is being transferred to the primary unwind location.

As shown, a second roll of material 38 is loaded into the staging area 14 of the frame 12 as unwinding of the first roll of material 22 continues. Referring to FIG. 4, once the roll of material 22 has reached a predetermined diameter, the roll can be transferred from the primary unwind location 16 to the secondary unwind location 18. Simultaneously or consecutively, the second roll of material 38 can be transferred from the staging area 14 to the primary unwind location 16.

Any suitable transfer mechanism can be used to transfer the first roll of material 22 to the secondary unwind location 18. During transfer, unwinding of the roll of material can cease or if desired, can continue. For instance, as shown in FIG. 4, in one embodiment the first drive device 28 can remain engaged with the first roll of material 22 during transfer to the second unwind location 18. In this manner, the first drive device can continue to unwind the first roll of material 22 during the roll change sequence until the roll reaches the secondary unwind location.

Figure 5:
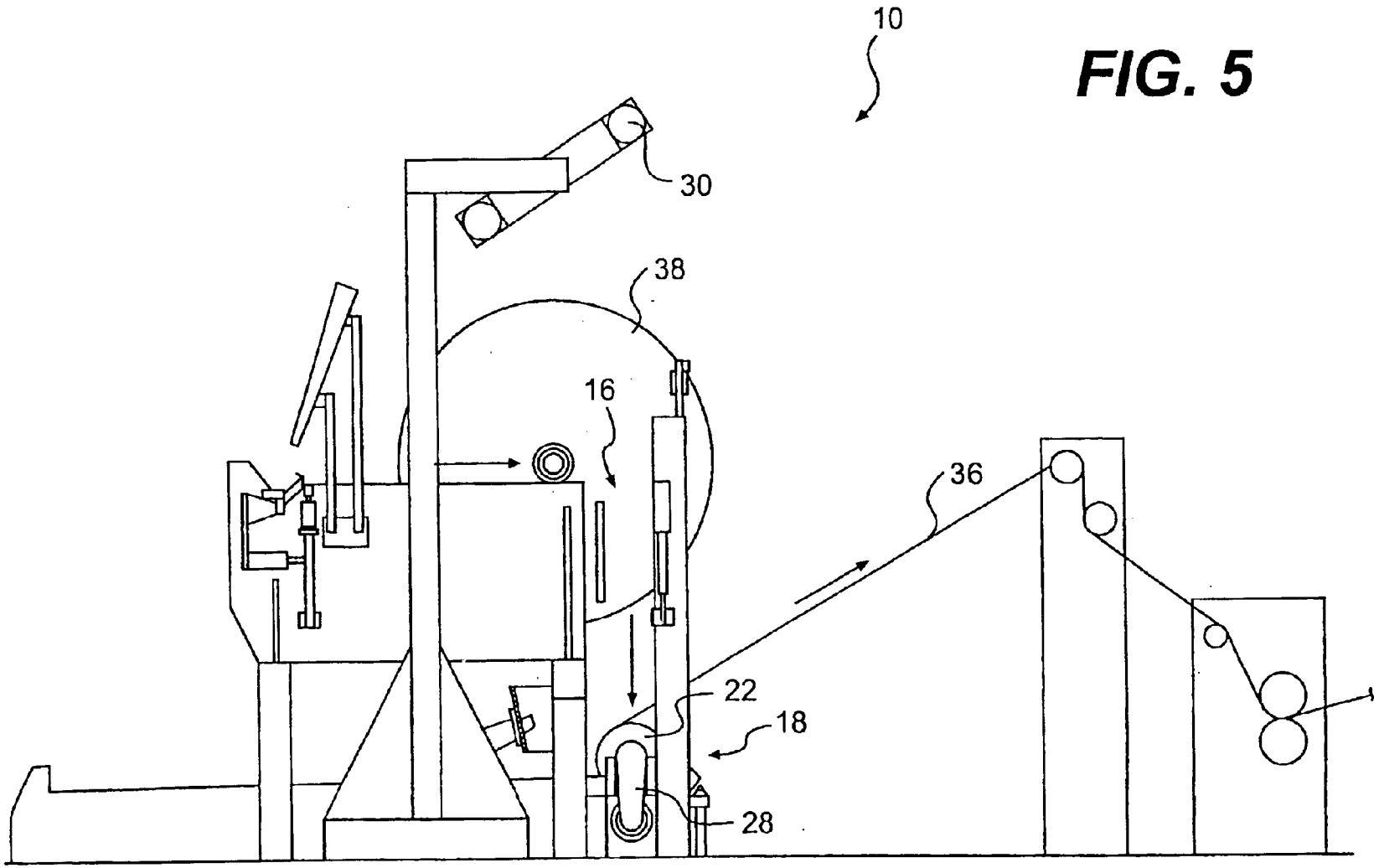
FIG. 5 is a side view of the system illustrated in FIG. 1 showing continued unwinding of a first roll of material at a secondary unwind location, while a second roll of material is being transferred to a primary unwind location.

Referring to FIG. 5, the roll of material 22 is shown in the secondary unwind location 18. As illustrated, first drive device 28 is still in engagement with the roll of material. Unwinding of the web 36 continues in the secondary unwind location 18. The second roll of material 38 is shown approaching the primary unwind location 16.

Figure 8:
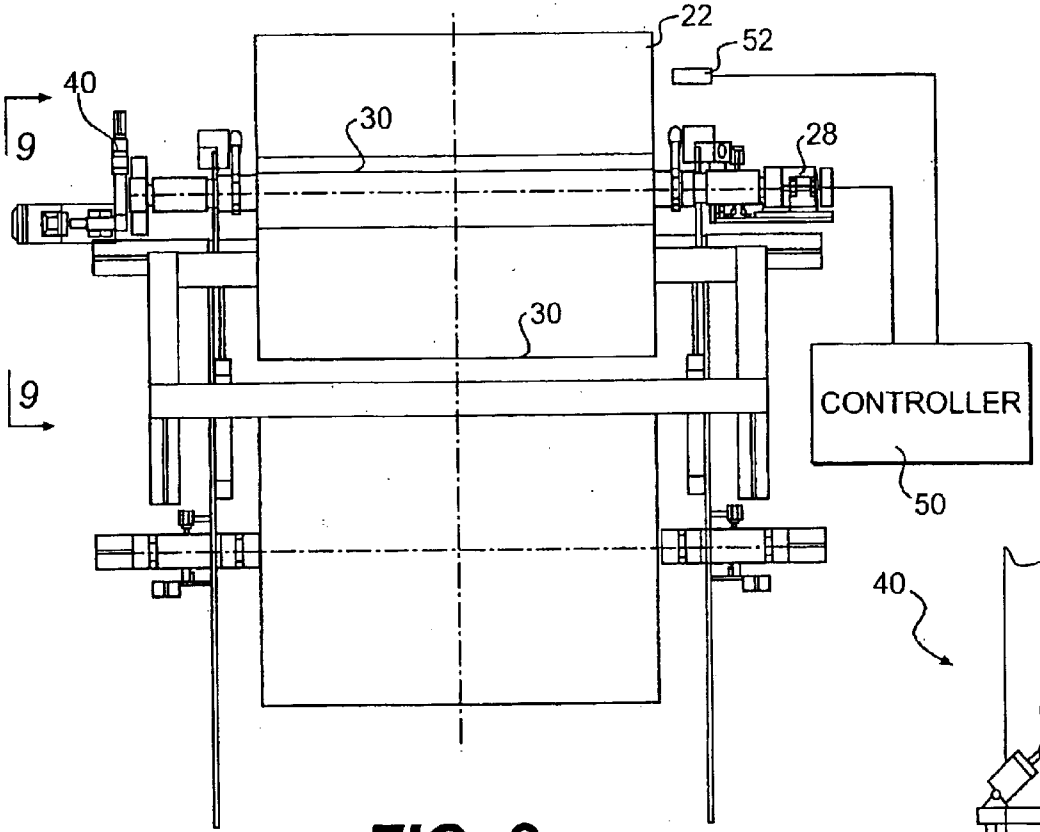
FIG. 8 is a top view of the system illustrated in FIG. 1.
Figure 9:
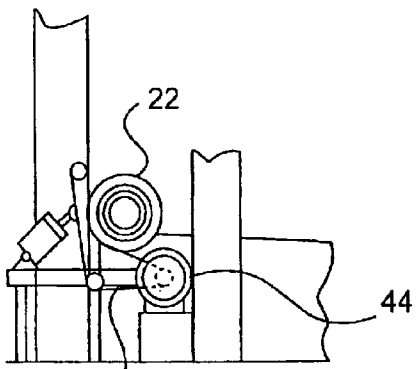
FIG. 9 is a side view with cut away portions of a drive device positioned at a secondary unwind location.

Referring to FIGS. 8 and 9, at the secondary unwind location 18 is a third drive device 40. In this embodiment, as particularly shown in FIG. 9, the third drive device 40 includes a belt 42 upon which the roll of material 22 rests. The belt 42 is driven by a motor 44. The belt 42 can contact the outside surface of the roll of material as a surface drive device. Alternatively, however, as shown in FIG. 8, the belt 42 can contact the core or spool upon which the material is wound. In this manner, the third drive device 40 acts more like a center unwind device. Third drive device 40 is used to continue unwinding the roll 22 as the first drive device 28 disengages from the roll and returns to the primary unwind location 16.

Figure 6:
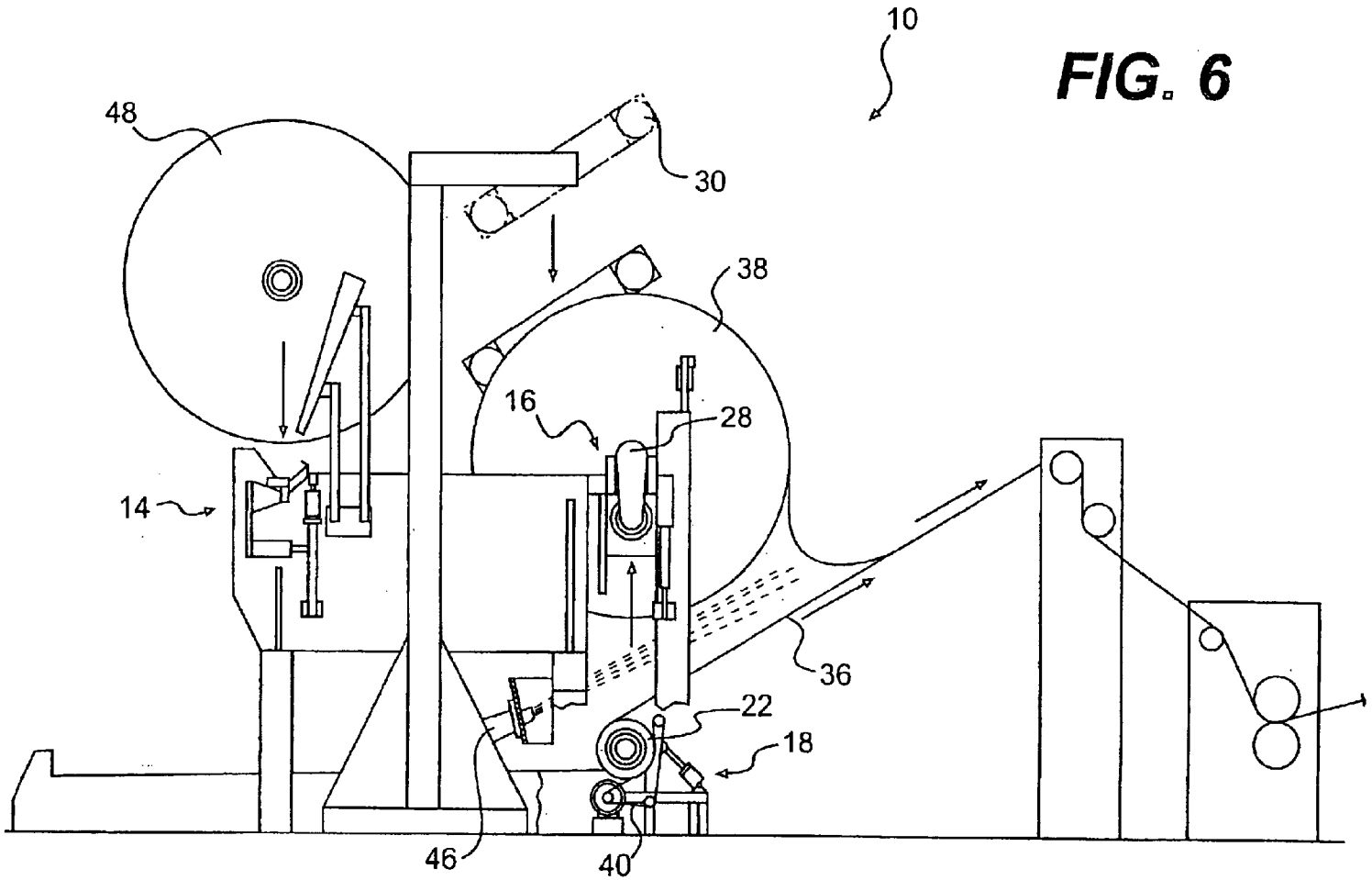
FIG. 6 is a side view of the system illustrated in FIG. 1 showing a first roll of material almost completely unwound at a secondary unwind location being spliced with a second roll of material positioned at a primary unwind location.

For example, referring to FIG. 6, the first drive device 28 is shown returning to the primary unwind location 16 and engaging the second roll of material 38. Unwinding of the first roll of material 22, however, is continued at the secondary unwind location 18 by the third drive device 40. The third drive device 40 unwinds the roll of material 22 at a predetermined unwind speed in preparation for splicing with the second roll of material 38.

As shown in FIG. 6, as first drive device 28 engages the second roll of material 38, the second drive device 30 also engages the roll at its outside surface. Through the combination of the first drive device 28 and the second drive device 30, rotation of the second roll of material 38 is initiated. The second roll of material 38 is accelerated by both the first drive device 28 and the second drive device 30 to generally match the web speed of the web 36 being unwound from the secondary unwind location 18. As the second roll of material 38 is unwound, the leading edge of the material falls on top of the web 36 due to the force of gravity.

As shown in FIG. 6, the system can include additional means, such as an air nozzle 46 which emits a curtain of air or other gas to facilitate peeling the leading edge of the web from the second roll of material 38 and to ensure that the new web lands onto the existing web 36 that is already threaded through the process. It should be understood, however, that the use of the air nozzle 46 or any other similar device is optional.

Once both webs have been placed together, the webs proceed at the same speed to a ply bonding process downstream. The plies can be bonded together using, for instance, ply crimpers, a set of nip rolls, an embossing roll or through the use of an adhesive. Once the plies have been bonded together, the third drive device 40 ceases torque transmission to the first roll of material 22, which causes the web 36 to sever.

Figure 7:
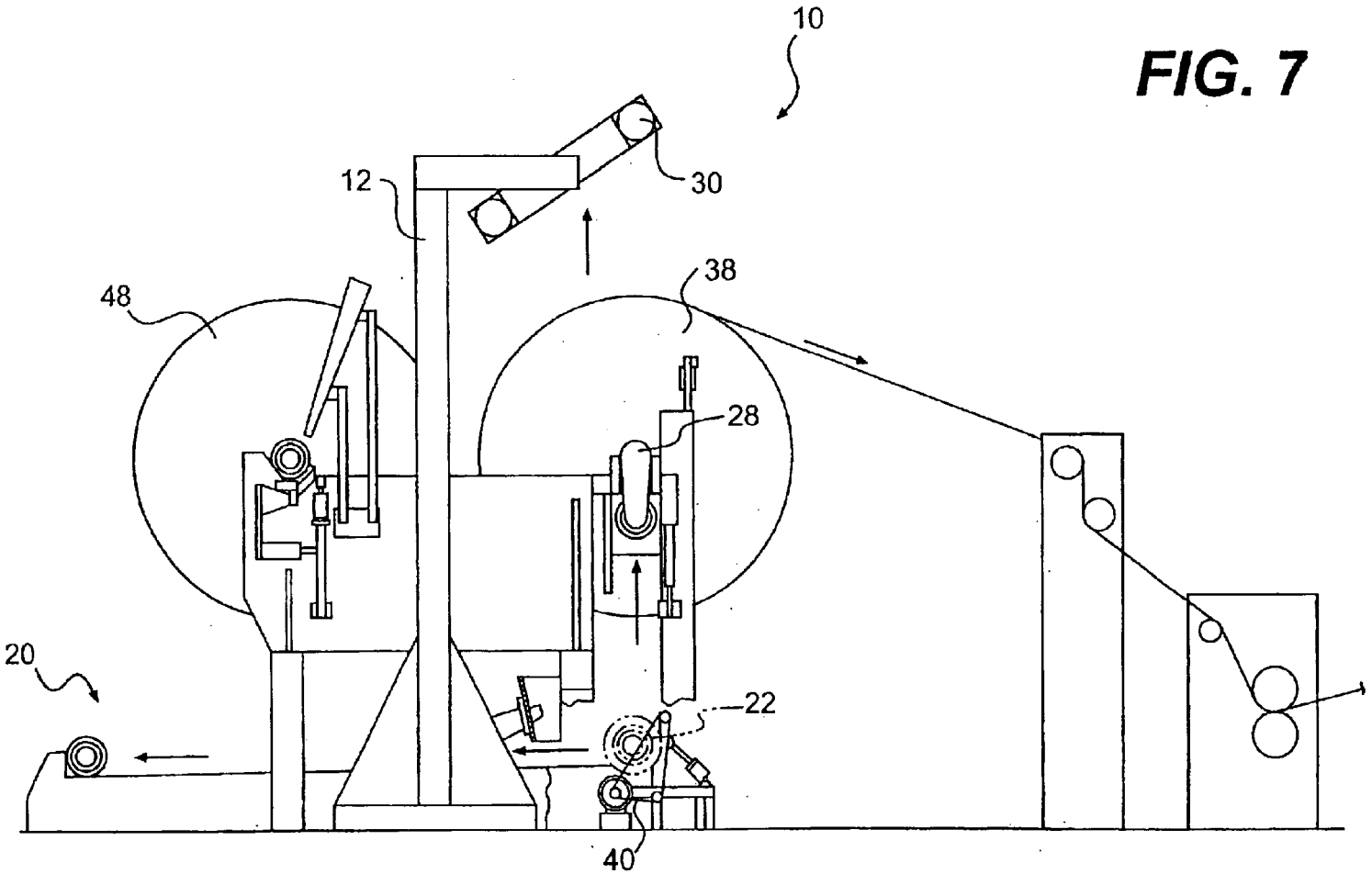
FIG. 7 is a side view of the system illustrated in FIG. 1 showing the unwinding of a roll of material at a primary unwind location, while an exhausted roll of material is being transferred to a collecting area.

Referring to FIG. 7, after the webs have been spliced together and web 36 has been severed, the remaining roll 22 is disengaged from the third drive device 40. The expired roll in the secondary unwind location 18 can be manually or automatically slabbed down for waste removal. The expired roll can be relocated and secured in a convenient, fixed position for the wound material to be cut or peeled off. The waste paper material can fall to the floor or onto a conveyor for subsequent removal from the area beneath the system. If included in the roll, the bare shaft or core can be released from the secondary unwind position and transferred to a collecting position 20 as shown in FIG. 7. In one embodiment, the frame 12 can include a set of rails which have a strategic grade so as to permit the shaft or core to roll downhill towards the collecting area 20.

During removal of the first roll of material 22 from the secondary unwind position 18, the second roll of material 38 can be unwound from the primary unwind location 16 as described above. As shown in FIGS. 6 and 7, a third roll of material 48 can be loaded into the staging area 14 of the frame 12 for processing in accordance with the present invention.

As described in the embodiment above, the system and process of the present invention use at least two drive devices to unwind rolls of material and allow for the splicing of the rolls without ever having to stop the operating process. Moreover, since rolls of materials processed by the system of the present invention only move in a direction perpendicular to their rotational axis as opposed to any movement parallel to their rotational axis, the system can unwind very wide parent rolls, such as rolls having the width of the paper making machine itself without delays associated with cross-directional movement. Furthermore, the system of the present invention can be completely automated if desired.

For example, as shown in FIG. 8, the system can include a controller 50 for controlling all of the drive devices and any transfer mechanisms. The controller 50 can be, for instance, a microprocessor or a programmable logic unit.

In one embodiment, various sensors can be included in the system in order to provide information to the controller 50 for control of the various operations that occur during unwinding. For instance, as shown in FIG. 8, the system can include a roll diameter sensor 52 that senses the diameter of the roll of material 22. Based on information received from the sensor 52, the controller can determine when it is time to transfer the roll of material 22 from the primary unwind location to the secondary unwind location.

Besides a roll diameter sensor, the system can also include a rotational speed sensor. The rotational speed sensor can provide information for determining when it is time to engage and disengage the second drive device 30. Speed sensors can also be used to match the speed between the first roll of material 22 and the second roll of material 38 during splicing.

The system and sequence of events illustrated in FIGS. 1 through 7 represent one embodiment of the present invention. It should be understood, however, that various modifications can be made to the system without departing from the scope of the invention. For instance, in an alternative embodiment, when a roll of material is transferred from the primary unwind location to the secondary unwind location, the roll can be engaged by the second drive device 30 instead of the first drive device 28. The second drive device can continuously unwind the roll of material as the material is placed in the secondary unwind location. After the roll of material is positioned in the secondary unwind location, the second drive device 30 can then return to the primary unwind location.

As described above, for many applications, the second drive device 30 is only used to initiate rotation of the roll of material in the primary unwind location. In this embodiment of the present invention, however, the second drive device can be used to initiate the unwinding of the roll of material and then disengage from the material. After the roll of material has partially unwound, the second drive device can once again be brought into engagement with the roll for further unwinding and transfer to the secondary unwind location.

When processing high bulk tissue webs, surface unwind devices can create sheet damage when contacting rolls of materials having relatively large diameters, such as greater than about 85 inches. When the diameter of the roll of material is less than about 85 inches, use of a surface drive device to transmit torque through a high bulk tissue web will normally not damage the web. Thus, when using the second drive device to transfer the roll of material from the primary unwind location to the secondary unwind location and the roll of material is a high-bulk product, in some applications it may be desirable for the second drive device to initially engage the roll of material, disengage the roll of material, and then re-engage the roll of material after the diameter has been sufficiently reduced.

In the embodiment illustrated in FIGS. 6 and 7, the third drive device 40 is shown as a surface unwind device. In another alternative embodiment of the present invention, however, the third drive device 40 can be a center unwind device that unwinds a roll of material by engaging the center of the roll. When the third drive device 40 is a center unwind device, the device can engage the roll of material on the side opposite the first drive device 28.

When the third drive device 40 is a center unwind device, in one embodiment, the third drive device can be configured to move between the primary unwind location 16 and the secondary unwind location 18. In this manner, the third drive device can be used to assist in transferring the roll of material from the primary unwind location to the secondary unwind location while continuously unwinding the material without interruption. In this embodiment, the third drive device can be configured to move between the different unwinding locations much like the first drive device 28 as shown in FIGS. 4 and 5.

These and other modifications and variations to the present invention may be practiced by those of ordinary skill in the art, without departing from the spirit and scope of the present invention, which is more particularly set forth in the appended claims. In addition, it should be understood that aspects of the various embodiments may be interchanged both in whole or in part. Furthermore, those of ordinary skill in the art will appreciate that the foregoing description is by way of example only, and is not intended to limit the invention so further described in such appended claims.

What is claimed:

1. An unwind system comprising:

a frame defining a primary unwind location and a secondary unwind location;

a first drive device adapted to engage a center portion of a roll of material to be unwound, said first drive device being positioned to engage said roll of material when said roll of material is in the primary unwind location;

a second drive device adapted to engage an outside surface of said roll of material when said roll of material is in the primary unwind location, said second drive device operating in conjunction with said first drive device to unwind said roll of material, the second drive device providing supplemental torque to the outside surface of the roll of material;

a transfer mechanism that transfers said roll of material from the primary unwind location to the secondary unwind location after a portion of said material has been unwound from said roll; and a third drive device positioned at the secondary unwind location, the third drive device for further unwinding said roll of material.

2. An unwind system as defined in claim 1, wherein said frame further defines a staging position for holding a roll of material prior to transfer to the primary unwind location.

3. An unwind system as defined in claim 2, wherein said first drive device is configured to move to said staging position, engage a roll of material and move with said roll of material to said primary unwind location for unwinding.

4. An unwind system as defined in claim 2, wherein said staging position is generally at the same elevation as said primary unwind location.

5. An unwind system as defined in claim 1, wherein the first drive device includes a chuck for engaging and unwinding a roll of material.

6. An unwind system as defined in claim 1, wherein said first drive device is configured to move with said roll of material from the primary unwind location to the secondary unwind location while continuously unwinding said roll, said first drive device being further configured to disengage said roll of material at the secondary unwind location.

7. An unwind system as defined in claim 1, wherein said second drive device comprises a driven belt, said second drive device being movable between a roll engagement position and a non-engagement position.

8. An unwind system as defined in claim 7, wherein the second drive device is configured to work in conjunction with the first drive device to unwind a roll of material and then to move to said non-engagement position after the material has reached a preselected unwind speed.

9. An unwind system as defined in claim 1, wherein said third drive device comprises a center unwind device that engages a center portion of a roll of material and unwinds said roll.

10. An unwind system as defined in claim 1, wherein said third drive device comprises a surface unwind device that engages a surface of a roll of material and unwinds the roll.

11. An unwind system as defined in claim 1, further comprising a controller and a roll diameter sensor, said controller being configured to receive information from the roll diameter sensor about the diameter of a roll being unwound in the primary unwind location and, based on said information, to automatically transfer the roll to the secondary unwind location upon reaching a predetermined diameter.

12. An unwind system as defined in claim 1, further comprising an air jet nozzle configuration for emitting air onto a leading end of a roll of material positioned at said primary unwind location for blowing said leading end onto a second web being unwound from said secondary unwind location.

13. An unwind system as defined in claim 1, wherein said secondary unwind location is located below said primary unwind location.

14. An unwind system for unwinding rolls of a web of material comprising:

a frame defining a primary unwind location;

a first drive device adapted to engage a center portion of a web of material to be unwound, said first drive device being positioned to engage said roll of material when said roll of material is in the primary unwind location; and a secondary drive device adapted to engage an outside surface of said roll of material when said roll of material is in the primary unwind location, said second drive device operating in conjunction with said first drive device to unwind said roll of material, said second drive device applying a tangential force and supplemental torque to said roll of material at least during initial rotation of said roll.

15. An unwind system as defined in claim 14, wherein said frame further defines a secondary unwind location and said system further includes a third drive device positioned at the secondary unwind location, the third drive device for further unwinding said roll of material.

16. An unwind system as defined in claim 15, wherein said third drive device comprises a center unwind device, said first drive device engaging one side of the center portion of the roll of material and said third drive device engaging an opposite side of the center portion, said third drive device being configured to move with said roll of material from the primary unwind location to the secondary unwind location while continuously unwinding said roll.

17. An unwind system as defined in claim 15, wherein said third drive device comprises a surface drive device.

18. An unwind system as defined in claim 15, wherein said first drive device is configured to move with said roll of material from the primary unwind location to the secondary unwind location while continually unwinding said roll, said first drive device being further configured to disengage with said roll of material at the secondary unwind location.

19. An unwind system as defined in claim 14, wherein said frame further defines a secondary unwind position and wherein said second drive device is configured to move with said roll of material from the primary unwind location to the secondary unwind location while continually unwinding said roll.

20. An unwind system as defined in claim 14, wherein said frame further defines a staging position for holding a roll of material prior to transfer to the primary unwind location, said staging position being generally at the same elevation as said primary unwind location.

21. An unwind system as defined in claim 14, wherein said second drive device is configured to work in conjunction with said first drive device to initiate the unwinding of a roll of material and then to disengage from the roll of material after the material has reached a preselected unwind speed.

22. A method of unwinding a soft, high bulk tissue web comprising the steps of:

providing a frame assembly having a primary unwind location and a secondary unwind location;

placing a roll of material comprising a tissue web in the primary unwind location, the roll of material including a center portion;

unwinding said roll of material by applying a torque to the center portion of said roll of material and by applying a tangential force and supplemental torque to an outside surface of said roll of material;

after unwinding a portion of the roll of material, transferring the roll of material to the secondary unwind location; and further unwinding said roll of material at said secondary unwind location.

23. A method as defined in claim 22, wherein said torque is applied to the center portion of the roll of material while the roll is transferred to the secondary unwind location so that unwinding of the roll is continuous during the transfer period.

24. A method as defined in claim 22, wherein said roll of material is unwound at the secondary unwind location by applying a tangential force to the outside surface of the roll.

25. A method as defined in claim 22, wherein said torque is applied to the center portion of the roll of material by a center unwind device.

26. A method as defined in claim 22, wherein the tangential force is applied to the outside surface of the roll of material by a surface unwind device, said surface unwind device comprising a moving belt that contacts the outside surface of the roll.

27. A method as defined in claim 22, wherein the frame assembly includes a staging location for holding a second roll of material to be transferred and unwound from the primary unwind location after the roll of material being unwound is transferred to the secondary unwind location.

28. A method as defined in claim 22, further comprising the steps of:

placing a second roll of material comprising a tissue web in the primary unwind location after the first roll of material has been transferred to the secondary unwind location;

unwinding said second roll of material by applying a torque to the center portion of the roll and by applying a tangential force to an outside surface of the roll of material;

splicing a free end of the second roll of material with the first roll of material being unwound at the secondary unwind location; and discontinuing the unwinding of the first roll of material.

29. A method as defined in claim 28, wherein said free end of said second roll of material is spliced with said first roll of material by being placed onto the top of the first roll of material as it is being unwound from the secondary unwind location.

30. A method as defined in claim 28, wherein said frame assembly further includes a collecting area and wherein after the unwinding of the first roll of material is discontinued, the first roll of material is ejected from the secondary unwind location and conveyed to the collecting area.

31. A method as defined in claim 22, wherein the tissue web comprises a creped tissue.

32. A method as defined in claim 22, wherein the tissue web comprises an uncreped throughdried tissue web.

33. A method as defined in claim 22, wherein the tissue web has a basis weight of less than about 30 lbs per ream.

34. A method as defined in claim 22, wherein initial unwinding of the roll of material at the primary unwind location occurs by simultaneously applying the torque to the center portion of the roll and the tangential force to the outside surface of the roll and wherein after the roll of material has achieved a determined unwind speed, the tangential force is no longer applied to the outside surface of the roll.

35. An unwind system comprising:

a frame assembly defining a primary unwind location and a secondary unwind location, said secondary unwind location located directly below said primary unwind location;

a first drive device adapted to engage a center portion of a roll of material to be unwound, said first drive device being positioned to engage said roll of material when the roll of material is in the primary unwind location.

36. An unwind system as defined in claim 35, further comprising a transfer mechanism that transfers the roll of material from the primary unwind location to the secondary unwind location after a portion of the material has been unwound from the roll; and a second drive device positioned at the secondary unwind location, the second drive device for further unwinding the roll of material.

37. An unwind system as defined in claim 35, wherein the frame assembly further comprises a staging position for holding a roll of material prior to transfer to the primary unwind location.

38. An unwind system as defined in claim 35, wherein the first drive device is configured to move with the roll of material from the primary unwind location to the secondary unwind location while continuously unwinding the roll.

39. An unwind system as defined in claim 35, further comprising a third drive device adapted to engage an outside surface of the roll of material when the roll of material is in the primary unwind location, the third drive device operating in conjunction with the first drive device to unwind the roll of material.

40. An unwind system as defined in claim 39, wherein the third drive device comprises a driven belt, said third drive device being movable between a roll engagement position and a non-engagement position.

41. An unwind system comprising:

a frame defining a primary unwind location and a secondary unwind location;

a first drive device adapted to engage a center portion of a roll of material to be unwound, said first drive device being positioned to engage said roll of material when said roll of material is in the primary unwind location;

a second drive device adapted to engage an outside surface of said roll of material when said roll of material is in the primary unwind location, said second drive device operating in conjunction with said first drive device to unwind said roll of material;

a transfer mechanism that transfers said roll of material from the primary unwind location to the secondary unwind location after a portion of said material has been unwound from said roll, the secondary unwind location being located below the primary unwind location; and a third drive device positioned at the secondary unwind location, the third drive device for further unwinding said roll of material.

* * * * *